US009828842B2

(12) United States Patent
Hyde et al.

(10) Patent No.: US 9,828,842 B2
(45) Date of Patent: Nov. 28, 2017

(54) SYSTEMS AND METHODS FOR RELEASING METHANE FROM CLATHRATES

(71) Applicant: Elwha LLC, Bellevue, WA (US)

(72) Inventors: Roderick A. Hyde, Redmond, WA (US); Lowell L. Wood, Jr., Bellevue, WA (US)

(73) Assignee: Elwha LLC, Bellevue, WA (US)

( * ) Notice: Subject to any disclaimer, the term of this patent is extended or adjusted under 35 U.S.C. 154(b) by 259 days.

(21) Appl. No.: 14/503,035

(22) Filed: Sep. 30, 2014

(65) Prior Publication Data

US 2016/0090828 A1 Mar. 31, 2016

(51) Int. Cl.

| | |
|---|---|
| ***E21B 43/243*** | (2006.01) |
| ***E21B 47/06*** | (2012.01) |
| *E21B 43/01* | (2006.01) |

(52) U.S. Cl.

CPC ..... *E21B 43/243* (2013.01); *E21B 47/065* (2013.01); *E21B 2043/0115* (2013.01)

(58) Field of Classification Search

CPC ..... E21B 43/243

See application file for complete search history.

(56) References Cited

U.S. PATENT DOCUMENTS

| | | | |
|---|---|---|---|
| 7,513,306 B2 | 4/2009 | Pfefferle | |
| 7,784,545 B2 | 8/2010 | Maguire | |
| 7,963,328 B2 | 6/2011 | Khinkis et al. | |
| 2007/0107901 A1 | 5/2007 | Maguire | |
| 2008/0121393 A1 | 5/2008 | Pfefferle | |
| 2009/0008090 A1* | 1/2009 | Schultz | E21B 43/243 166/260 |
| 2010/0243245 A1 | 9/2010 | Khinkis et al. | |
| 2012/0125610 A1 | 5/2012 | Prentice, III | |

OTHER PUBLICATIONS

Castaldi et al., "Down-hole combustion method for gas production from methane hydrates", Journal of Petroleum Science and Engineering, vol. 56, Mar. 2007, pp. 176-185.

* cited by examiner

*Primary Examiner* — Robert E Fuller
*Assistant Examiner* — Steven MacDonald
(74) *Attorney, Agent, or Firm* — Foley & Lardner LLP

(57) ABSTRACT

A system for removing methane from subterranean clathrates includes an oxidant source, a feed pipe, a recovery pipe, and an ignition source. The feed pipe includes an inlet end in fluid communication with the oxidant source and an outlet end configured to be disposed within a subterranean deposit that includes a stored methane gas disposed within a clathrate hydrate. The recovery pipe includes a first end disposed within the subterranean deposit and a second end opposite the first end configured to engage a storage device. The ignition source is configured to trigger a combustion reaction to melt the clathrate hydrate to produce a released methane gas. A first portion of the released methane gas travels along a recovery flow path through the recovery pipe and a second portion of the released methane gas combusts with the oxidant in-situ to perpetuate the combustion reaction.

24 Claims, 7 Drawing Sheets

SYSTEMS AND METHODS FOR RELEASING METHANE FROM CLATHRATES

BACKGROUND

Clathrates form below ground and have a crystalline water-based structure that may trap gases or other molecules. By way of example, methane gas may become trapped within the clathrate hydrate structure. Recovery of methane gas from hydrates is traditionally accomplished by replacing the methane with carbon dioxide or another gas. Such systems may employ a combustor that preheats the carbon dioxide and facilitates dissociation of the methane from the hydrate. The methane is thereafter collected for later use.

SUMMARY

One embodiment relates to a system for removing methane from subterranean clathrates that includes an oxidant source, a feed pipe, a recovery pipe, and an ignition source. The feed pipe includes an inlet end in fluid communication with the oxidant source and an outlet end configured to be disposed within a subterranean deposit that includes a stored methane gas disposed within a clathrate hydrate. The recovery pipe includes a first end disposed within the subterranean deposit and a second end opposite the first end configured to engage a storage device. The ignition source is configured to trigger a combustion reaction to melt the clathrate hydrate to produce a released methane gas. A first portion of the released methane gas travels along a recovery flow path through the recovery pipe and a second portion of the released methane gas combusts with the oxidant in-situ to perpetuate the combustion reaction.

Another embodiment relates to a system for removing methane from subterranean clathrates that includes a feed pipe extending through an underground volume and including an inlet end configured to be coupled to an oxidant source and an outlet end configured to be disposed within a subterranean methane clathrate deposit. The feed pipe defines an oxidant flow path between the inlet end and the outlet end. The system further includes an ignition source configured to trigger a combustion reaction to melt a clathrate hydrate associated with the subterranean methane clathrate deposit, a valve disposed along the oxidant flow path, a sensor configured to provide a sensing signal relating to a combustion rate of the combustion reaction, and a processing circuit. The processing circuit is configured to generate a command signal based upon the sensing signal, the command signal relating to a combustion reaction of methane gas from the subterranean methane clathrate deposit. The valve is configured to regulate the oxidant flow as a function of the command signal to control the combustion reaction.

Still another embodiment relates to a system for removing methane from subterranean clathrates that includes a recovery pipe extending through an underground volume and including a first end disposed within a subterranean methane clathrate deposit and a second end configured to engage a storage device. The system further includes an ignition source configured to trigger a combustion reaction to melt the subterranean methane clathrate deposit to produce a released methane gas, a valve disposed along the recovery pipe, and a processing circuit. The processing circuit is configured to generate a command signal to control operation of the valve. The valve is configured to regulate a flow of the released methane gas through the recovery pipe as a function of the command signal to control the combustion reaction.

Yet another embodiment relates to a method for removing methane from subterranean clathrates that includes directing an oxidant from an oxidant source to a subterranean deposit that includes a stored methane gas disposed within a clathrate hydrate, triggering a combustion reaction between the oxidant and methane gas to melt the clathrate hydrate and produce a released methane gas, and collecting a first portion of the released methane gas. A second portion of the released methane gas combusts in-situ to perpetuate the combustion reaction.

The foregoing summary is illustrative only and is not intended to be in any way limiting. In addition to the illustrative aspects, embodiments, and features described above, further aspects, embodiments, and features will become apparent by reference to the drawings and the following detailed description.

DETAILED DESCRIPTION

Figure 1:
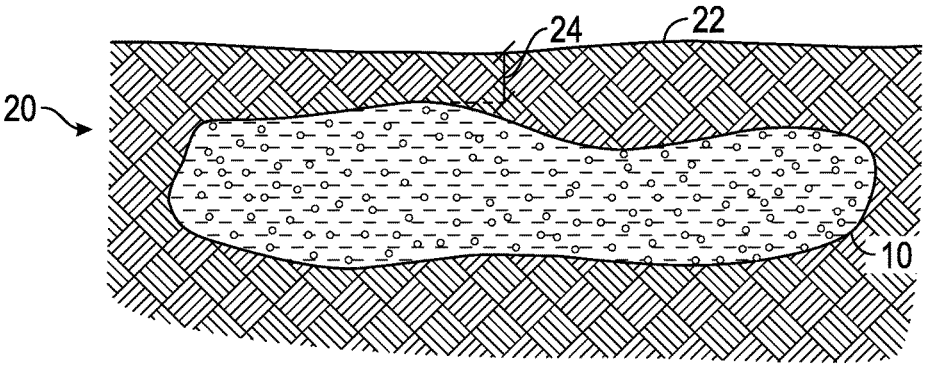
FIG. 1 is a sectional view of a subterranean deposit within an underground volume, according to one embodiment.

In the following detailed description, reference is made to the accompanying drawings, which form a part hereof. In the drawings, similar symbols typically identify similar components, unless context dictates otherwise. The illustrative embodiments described in the detailed description, drawings, and claims are not meant to be limiting. Other embodiments may be utilized, and other changes may be made, without departing from the spirit or scope of the subject matter presented here.

According to one embodiment, a system for removing methane from a clathrate (e.g., a crystalline water-based solid resembling ice) is configured to provide an oxidant (e.g., gaseous oxygen, liquid oxygen, air, etc.) to a subterranean deposit including methane gas disposed within a clathrate hydrate. The oxidant is used to facilitate a combustion reaction, which generates heat to melt the clathrate hydrate and releases methane gas. A portion of the methane gas is used to perpetuate the combustion reaction to generate additional heat to melt additional clathrate hydrate and releases more methane gas. The released methane gas may be collected and stored for later use.

In one embodiment, the combustion of the released methane gas occurs in-situ within the subterranean deposit. By way of example, released methane may be combusted along a surface of the clathrate. By way of another example, released methane may be combusted within a chamber formed by collapsed clathrate hydrate. Such in-situ combustion reduces energy losses associated with traditional combustion systems. In one embodiment, in-situ combustion reduces the energy losses associated with collecting and mixing the released methane gas or transporting an external fuel for combustion within the subterranean deposit.

Clathrate hydrates are crystalline water-based structures (e.g., a type 1 crystallographic cubic structure, a type 2 crystallographic cubic structure, etc.) forming cages or other lattice arrangements that define an inner volume. The clathrate hydrates may trap gases or other substances within the inner volumes of the water-based structures. By way of example, small non-polar gas molecules (e.g., methane) may be trapped inside hydrogen-bonded water molecules. The hydrates are formed under certain conditions. By way of example, low temperatures may be required to maintain the lattice structure of the hydrate. By way of another example, high pressures may be required to maintain the lattice structure of the hydrate.

Figure 2:
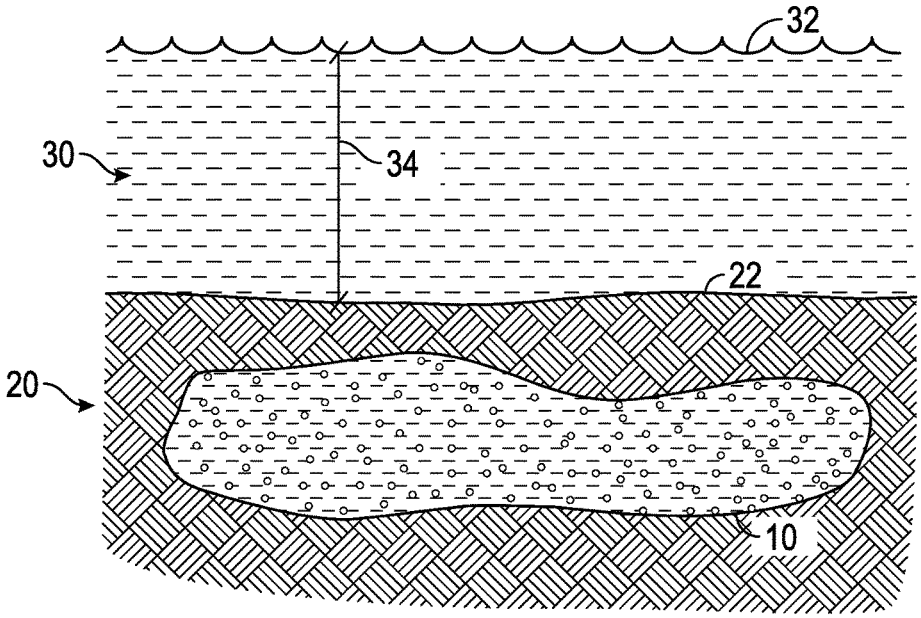
FIG. 2 is a sectional view of a subterranean deposit within an underground volume and positioned below a body of water, according to one embodiment.

Referring to FIGS. 1-2, a subterranean deposit is formed below a ground surface and includes stored methane gas disposed within a clathrate hydrate. As shown in FIG. 1, the subterranean deposit, shown as underground deposit 10, is formed within underground volume 20. Underground volume 20 may include a permafrost layer and may have temperature and pressure conditions that facilitate the natural formation of underground deposit 10. As shown in FIG. 1, underground deposit 10 is formed a depth 24 below a ground interface, shown as ground surface 22. Depth 24 at which underground deposit 10 forms may vary depending on the temperature and pressure conditions within underground volume 20. By way of example, depth 24 may be approximately 200 meters.

Referring to FIG. 2, underground deposit 10 is formed within underground volume 20. By way of example, underground volume 20 may include a sedimentary layer. Underground volume 20 may be located a depth 34 below a surface interface, shown as ocean surface 32, of a body of water, shown as ocean 30. Depths 34 below which underground deposit 10 may form varies depending on the temperature and pressure conditions within underground volume 20. By way of example, depth 34 may be approximately 460 meters. As shown in FIG. 2, underground volume 20 interfaces with ocean 30 at ground surface 22.

Figure 3:
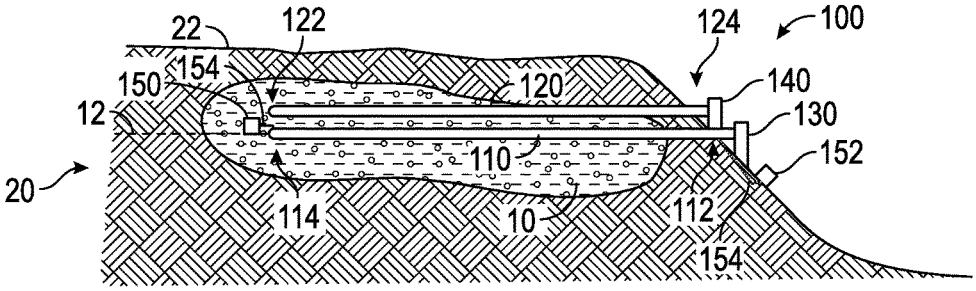
FIGS. 3-4 are sectional views of a system for removing methane from a subterranean deposit, according to one embodiment.
Figure 4:
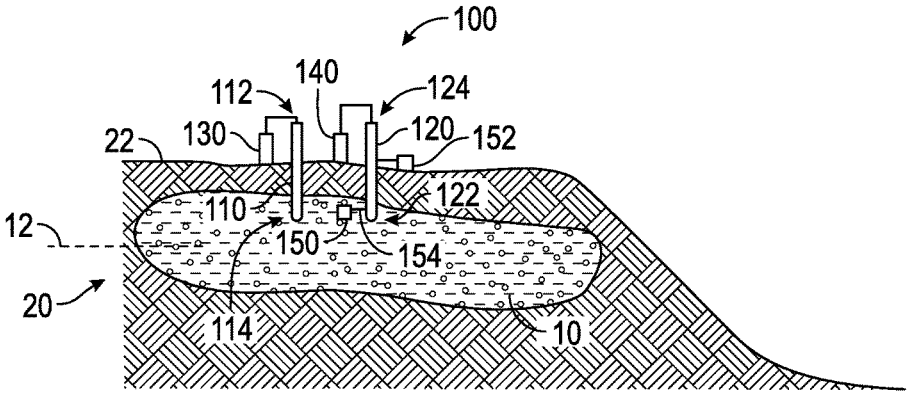

Referring next to FIGS. 3-4, system 100 used to remove methane from underground deposit 10 is shown according to one embodiment. As shown in FIGS. 3-4, system 100 includes a feed pipe, shown as feed pipe 110, and a recovery pipe, shown as recovery pipe 120, that both extend through underground volume 20. According to one embodiment, feed pipe 110 includes an inlet end 112 and an outlet end 114. As shown in FIGS. 3-4, inlet end 112 of feed pipe 110 is in fluid communication with oxidant source 130, and outlet end 114 of feed pipe 110 is disposed within underground deposit 10. Outlet end 114 may include a single outlet (e.g., at the far end of feed pipe 110 or another site along it) or it may include multiple outlets (e.g., at a plurality of sites along a portion of feed pipe 110 within underground deposit 10). According to another embodiment, inlet end 112 is in fluid communication with oxidant source 130 and outlet end 114 is configured to be disposed within a subterranean deposit that includes stored methane gas disposed within a clathrate hydrate. As shown in FIGS. 3-4, recovery pipe 120 includes first end 122 and second end 124. In the embodiment shown in FIGS. 3-4, first end 122 of recovery pipe 120 is disposed within underground deposit 10 and second end 124 of recovery pipe 120 engages storage device 140. First end 122 may include a single inlet (e.g., at the far end of recovery pipe 120 or another site along it) or it may include multiple inlets (e.g., at a plurality of sites along a portion of recovery pipe 120 within underground deposit 10). In another embodiment, second end 124 of recovery pipe 120 is configured to engage a storage device.

According to one embodiment, an oxidant flows from oxidant source 130 to underground deposit 10. The oxidant may include compressed air, compressed gaseous oxygen, liquid oxygen, or still another oxidant. In one embodiment, the oxidant includes liquid oxygen, and at least a portion of feed pipe 110 is thermally insulated. The oxidant source 130 may include a tank having a shell defining an inner volume. By way of example, oxidant source 130 may be configured to store compressed air, compressed gaseous oxygen, liquid oxygen, or still another oxidant within the internal volume.

Referring still to the embodiment shown in FIGS. 3-4, system 100 includes an ignition source 150. As shown in FIGS. 3-4, ignition source 150 is positioned within underground deposit 10. Ignition source 150 may include a single ignition element (e.g., proximate a single outlet end 114 of feed pipe 110) or it may include multiple ignition elements (e.g., at a plurality of outlet ends 114, distributed along a portion of feed pipe 110 within underground deposit 10, etc.). In one embodiment, ignition source 150 is coupled to a control module 152 with a tether 154. Control module 152 may regulate or otherwise engage ignition source 150. Ignition source 150 is configured to trigger a combustion reaction to melt the clathrate hydrate and release methane gas, according to one embodiment. The combustion reaction may be a flame combustion reaction or a catalytic combustion reaction, according to various embodiments. In one embodiment, ignition source 150 includes a spark generator configured to ignite at least one of methane from underground deposit 10 and a starter fuel. The ignition from the spark generator facilitates a flame combustion reaction within underground deposit 10, according to one embodiment. By way of example, the spark generator may include a piezoelectric igniter. According to another embodiment, ignition source 150 includes a catalytic substance (e.g., platinum, palladium, etc.) configured to combust at least one of methane from underground deposit 10 and a starter fuel. The combustion from the catalytic substance facilities a catalytic combustion reaction within underground deposit 10, according to one embodiment.

Ignition source 150 is configured to trigger a combustion reaction according to one embodiment. By way of example, ignition source 150 may ignite or combust an initial volume of methane from underground deposit 10. The initial volume of methane may be naturally occurring within underground deposit 10 or generated using a mechanical process or a thermal process. Ignition or combustion of the initial volume of methane from underground deposit 10 produces an exothermic reaction, thereby generating heat to melt a portion of the clathrate hydrate of underground deposit 10. Melting the clathrate hydrate releases additional methane gas previously stored therein, which combusts to perpetuate the reaction.

By way of another example, ignition source 150 may ignite or combust a starter fuel. In one embodiment, the starter fuel is provided to underground deposit 10 with feed pipe 110. In another embodiment, system 100 includes a separate pipe or device configured to provide the starter fuel to underground deposit 10. Ignition or combustion of the starter fuel produces an exothermic reaction, thereby generating heat to melt a portion of the clathrate hydrate of underground deposit 10. Melting the clathrate hydrate releases additional methane gas previously stored therein, which combusts to perpetuate the combustion reaction. By way of still another example, system 100 includes another device (e.g., a device that generates heat through exothermic oxidation, a device that generates heat through exothermic crystallization of a supersaturated solution, etc.) to melt an initial portion of the clathrate hydrate, thereby releasing methane, which is at least one of ignited and combusted with ignition source 150.

According to one embodiment, system 100 recovers a portion of the released methane. By way of example, the released methane may travel through recovery pipe 120 and may be deposited into storage device 140. In one embodiment, a fluid transfer device (e.g., a fan, a compressor, etc.) facilitates the flow of the released methane through recovery pipe 120. In another embodiment, a pressure differential through recovery pipe 120 facilitates flow therethrough.

In one embodiment, system 100 is configured to recover a first portion of the released methane and utilize a second portion of the released methane to perpetuate (e.g., continue) the combustion reaction. By way of example, the first portion of the released methane gas may travel along a recovery flow path through recovery pipe 120, and the second portion of the released methane gas may combust in-situ to perpetuate the combustion reaction.

According to the embodiment shown in FIG. 3, feed pipe 110 and recovery pipe 120 extend laterally through underground volume 20. By way of example, feed pipe 110 and recovery pipe 120 may be parallel to longitudinal axis 12 defined by underground deposit 10 (e.g., defined along a middle portion of underground deposit 10, defined along a length of underground deposit 10, etc.). By way of another example, feed pipe 110 and recovery pipe 120 may be parallel to at least a portion of ground surface 22. According to the embodiment shown in FIG. 4, feed pipe 110 and recovery pipe 120 extend vertically through underground volume 20. By way of example, feed pipe 110 and recovery pipe 120 may be perpendicular to longitudinal axis 12. By way of another example, feed pipe and recovery pipe 120 may be perpendicular to at least a portion of ground surface 22. According to still another embodiment, feed pipe 110 and recovery pipe 120 are angularly offset relative to at least one of longitudinal axis 12 and ground surface 22.

As shown in FIGS. 3-4, feed pipe 110 and recovery pipe 120 extend along a straight path. According to another embodiment, at least one of feed pipe 110 and recovery pipe 120 is otherwise shaped. By way of example, at least one of feed pipe 110 and recovery pipe 120 may be curved, include a plurality of constituent elements that are angularly offset relative to one another, or have still another shape. As shown in FIGS. 3-4, feed pipe 110 and recovery pipe 120 extend parallel to one another. In other embodiments, feed pipe 110 and recovery pipe 120 are angularly offset.

In one embodiment, system 100 regulates the combustion reaction with a buffer fluid. By way of example, the buffer fluid may be configured to control at least one of an ignition (e.g., a spread rate, an ignition timing, etc.) and an energetic (e.g., the activation energy, the temperature, etc.) of the combustion reaction. The buffer fluid may include nitrogen, carbon dioxide, or another fluid and may be in gaseous or liquid form. According to one embodiment, oxidant source 130 is configured to store an oxidant and the buffer fluid. Oxidant source 130 may store the oxidant and the buffer fluid at a mix ratio. In one embodiment, the mix ratio remains fixed during the combustion reaction. By way of example, ten percent buffer fluid (e.g., nitrogen, carbon dioxide, etc.) may be mixed within ninety percent oxidant (e.g., oxygen) for a mix ratio of ten percent buffer fluid. The mixture of oxidant and buffer fluid may together travel through feed pipe 110 to underground deposit 10.

The buffer fluid dilutes the oxidant and reduces the risk that the combustion reaction will expand according to an unintended profile (i.e., the spread of the combustion reaction within underground deposit 10 will be reduced for a mixture of the oxidant and buffer fluid), according to one embodiment. The buffer fluid may be an inert noble gas or another gas that does not contribute to the combustion reaction. In other embodiments, the buffer fluid actively contributes to the combustion reaction and otherwise controls an ignition or an energetic of the combustion reaction.

Figure 5:
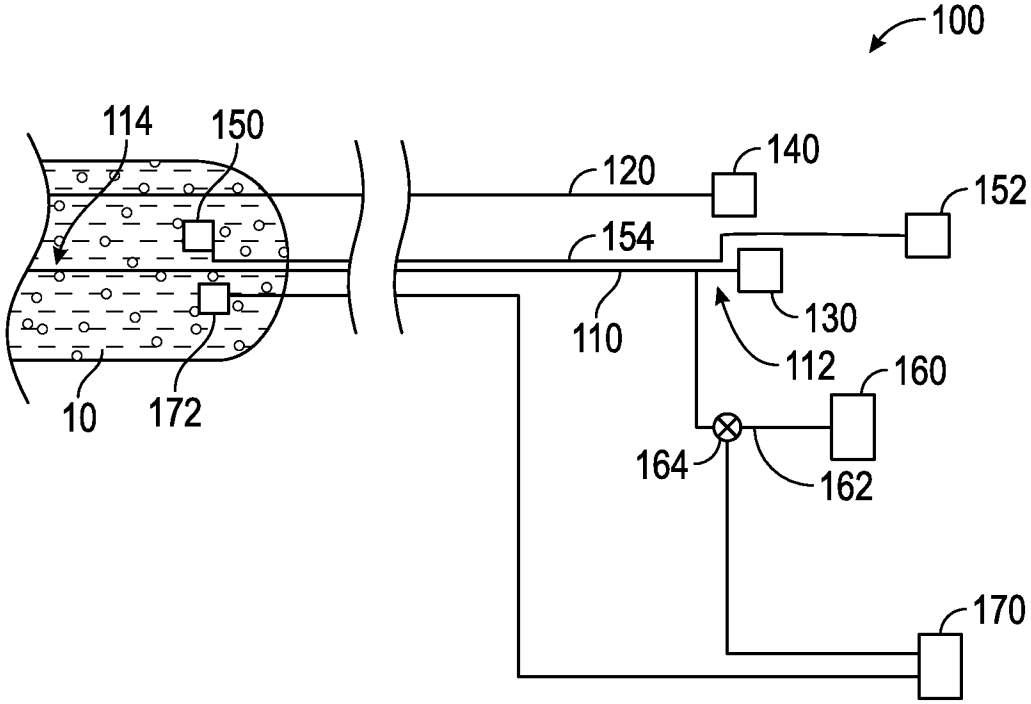
FIG. 5 is a schematic view of a system for removing methane from a subterranean deposit that includes a buffer fluid source, according to one embodiment.

Referring next to FIG. 5, system 100 includes buffer fluid source 160. In one embodiment, buffer fluid source 160 is configured to provide a buffer fluid to underground deposit 10. By way of example, the buffer fluid source may include a compressor, a fan, a pump, or another fluid transfer device. Buffer fluid source 160 (e.g., via a compressor) may control one or more characteristics (e.g., pressure, flow rate, etc.) of a buffer fluid flow. In one embodiment, buffer fluid source 160 controls at least one characteristic of the buffer fluid flow such that the buffer fluid is provided according to a mix ratio (e.g., a ratio of the buffer fluid to the oxidant).

Referring again to FIG. 5, feed pipe 110 defines an oxidant flow path end between inlet end 112 and outlet end 114. As shown in FIG. 5, buffer fluid source 160 is in fluid communication with the oxidant flow path via a pipe 162. In other embodiments, buffer fluid source 160 is in fluid communication with underground deposit 10 via a separate buffer feed pipe (i.e., line, conduit, etc.).

In another embodiment, buffer fluid source 160 is configured to store the buffer fluid and is in fluid communication with underground deposit 10. By way of example, buffer fluid source 160 may include a tank having a shell defining an internal volume. The buffer fluid may be stored within the internal volume of buffer fluid source 160. As shown in FIG. 5, buffer fluid source 160 is in fluid communication with the oxidant flow path via pipe 162. In one embodiment, the tank includes an outlet port in fluid communication with feed pipe 110.

A flow path may be defined between buffer fluid source 160 and underground deposit 10. In one embodiment, the buffer fluid flows through feed pipe 110 such that the flow path between buffer fluid source 160 and underground deposit 10 includes at least a portion of the oxidant flow path. As shown in FIG. 5, valve 164 is disposed along pipe 162. Valve 164 may be actuated between an open position and a closed position. In another embodiment, valve 164 is otherwise disposed along the flow path between buffer fluid source 160 and underground deposit 10 (e.g., along a buffer feed pipe, etc.). Valve 164 is configured to facilitate providing the buffer fluid at the mix ratio, according to one embodiment.

Referring again to FIG. 5, system 100 includes a processing circuit 170 configured to determine the mix ratio for the buffer fluid and generate a command signal. Processing circuit 170 may be implemented as a general-purpose processor, an application specific integrated circuit (ASIC), one or more field programmable gate arrays (FPGAs), a digital-signal-processor (DSP), circuits containing one or more processing components, circuitry for supporting a microprocessor, a group of processing components, or other suitable electronic processing components.

In one embodiment, processing circuit 170 includes a processor and a memory. The processor may include an ASIC, one or more FPGAs, a DSP, circuits containing one or more processing components, circuitry for supporting a microprocessor, a group of processing components, or other suitable electronic processing components. In some embodiments, the processor is configured to execute computer code stored in the memory to facilitate the activities described herein. The memory may be any volatile or non-volatile computer-readable storage medium capable of storing data or computer code relating to the activities described herein. In one embodiment, the memory includes one or more code modules (e.g., executable code, object code, source code, script code, machine code, etc.) configured for execution by the processor. In some embodiments, processing circuit 170 represents a collection of processing devices (e.g., servers, data centers, etc.). In such cases, the processor may be the collective processors of the devices, and the memory may be the collective storage devices of the devices. When executed by the processor, processing circuit 170 is configured to complete the activities described herein.

As shown in FIG. 5, processing circuit 170 is coupled to valve 164. In one embodiment, the command signal from processing circuit 170 actuates valve 164 between the open position and the closed position. With valve 164 in an open position, the buffer fluid flows from buffer fluid source 160. In one embodiment, a flow rate of the buffer fluid from buffer fluid source 160 varies based on the configuration of the valve. Valve 164 may open or close as a function of the command signal from processing circuit 170. Processing circuit 170 may thereby facilitate providing the buffer fluid to underground deposit 10 according to the mix ratio. In another embodiment, processing circuit 170 acts to control the mix ratio by controlling flow of the oxidant from oxidant source 130 or through feed pipe 110 (e.g., via a controllable oxidant valve).

According to another embodiment, buffer fluid source 160 is configured to provide the buffer fluid as a function of the command signal generated by processing circuit 170. In one embodiment, the command signal engages buffer fluid source 160. By way of one example, the command signal may turn "on" or "off" buffer fluid source 160. By way of another example, buffer fluid source 160 may vary at least one of a pressure, a temperature, and a flow rate of the buffer fluid based on the command signal.

In one embodiment, processing circuit 170 receives the mix ratio from a user interface (i.e., a user may provide the mix ratio to processing circuit 170). According to the embodiment shown in FIG. 5, processing circuit 170 determines the mix ratio based upon a sensor input from sensor 172. In the embodiment shown in FIG. 5, the sensor input is related to one or more conditions within underground deposit 10 (e.g., a temperature within underground deposit 10, an oxidant level within underground deposit 10, a pressure within underground deposit 10, a methane level within underground deposit 10, a carbon dioxide level within underground deposit 10, a water vapor level within underground deposit 10, etc.). The conditions may include at least one of a concentration, a partial pressure, a spatial distribution, and a rate of generation, among other measurements or characteristics. By way of example, sensor 172 may include a temperature sensor, an oxygen sensor, a pressure sensor, a methane sensor, a carbon dioxide sensor, a water vapor sensor, or still another device. In another embodiment, sensor 172 includes a flow rate sensor and is configured to provide sensing signals relating to a flow rate of oxidant from oxidant source 130. One or more sensors 172 may be coupled to processing circuit 170 and be configured to provide corresponding sensing signals to facilitate the determination of the mix ratio.

Figure 6:
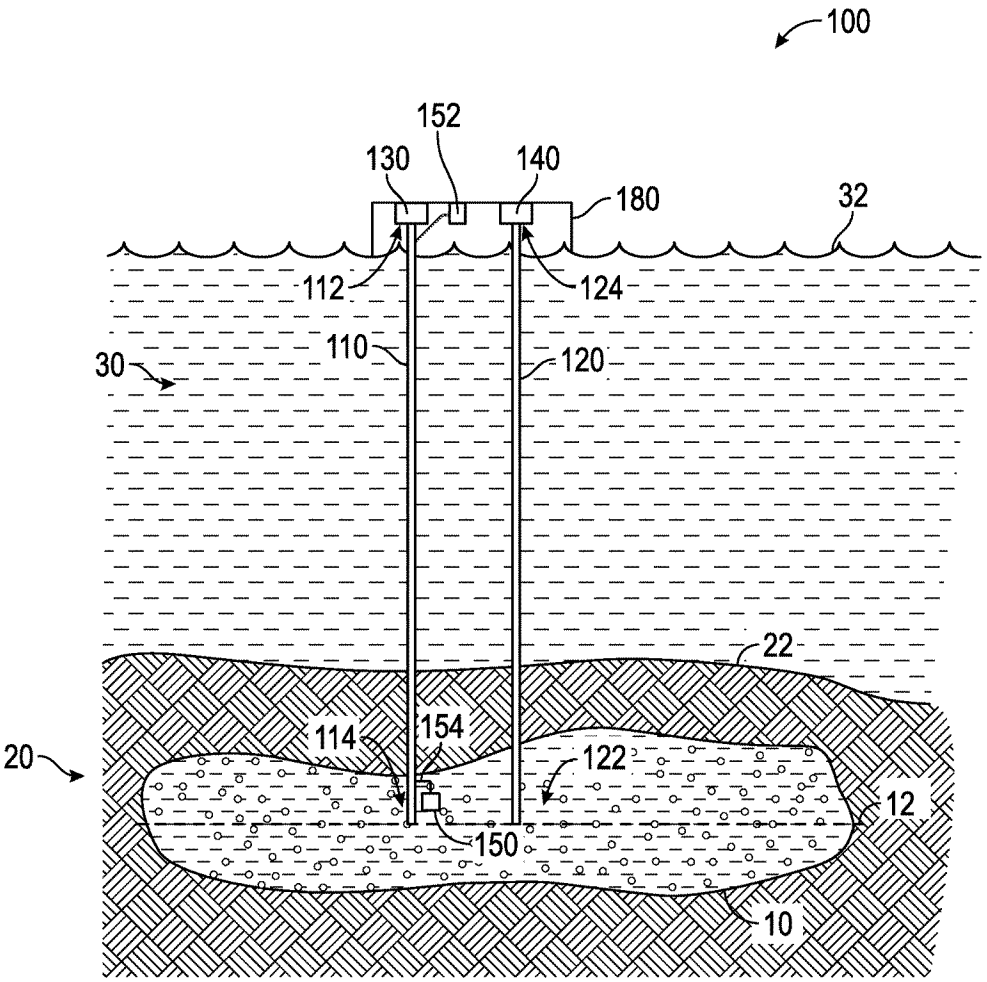
FIGS. 6-7 are sectional views of a system for removing methane from a subterranean deposit positioned below a body of water, according to one embodiment.
Figure 7:
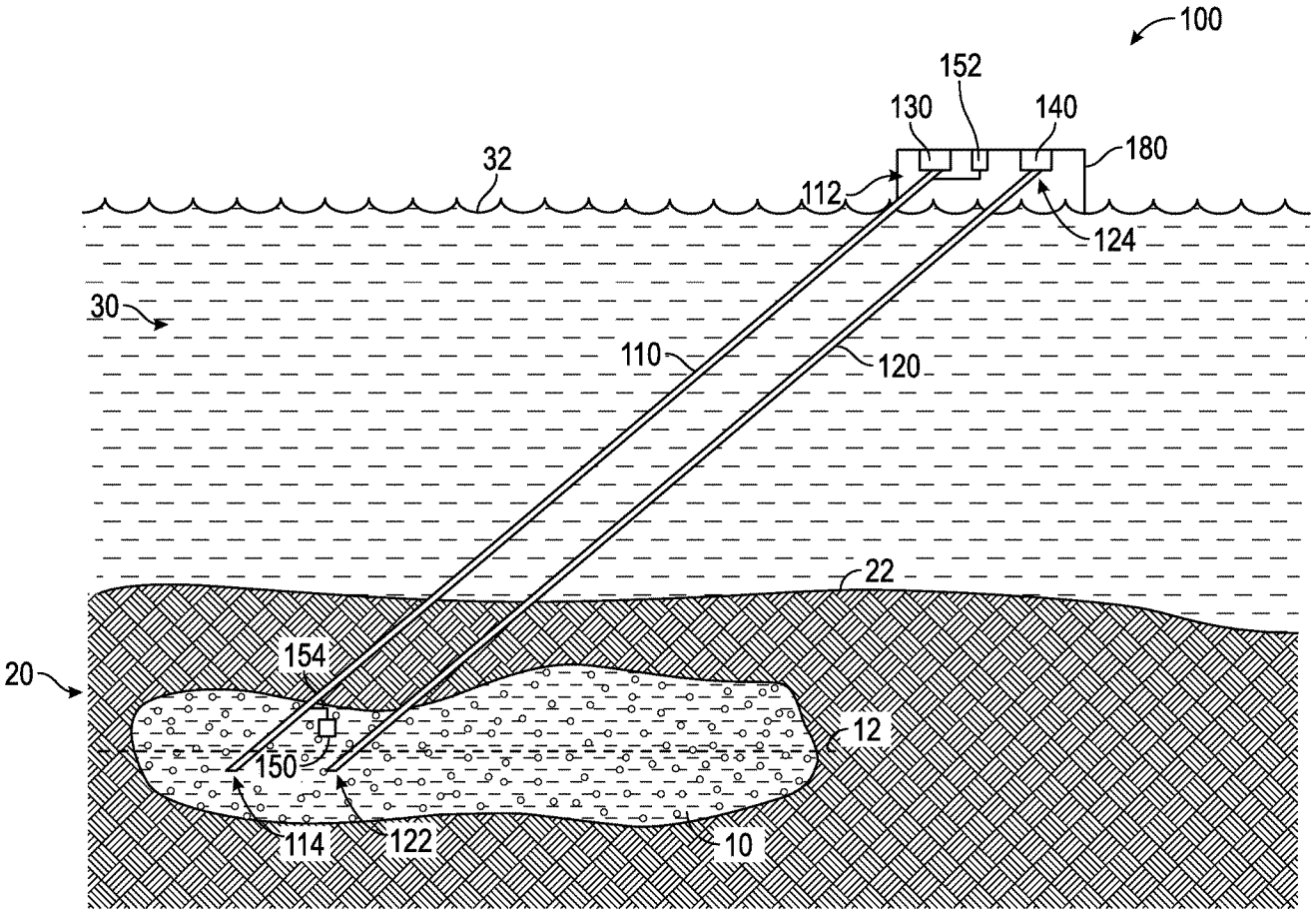

Referring next to the FIGS. 6-7, system 100 is configured to remove methane from underground deposit 10 disposed within underground volume 20 below ocean 30. As shown in FIGS. 6-7, feed pipe 110 and recovery pipe 120 extend into underground deposit 10 through ocean 30 and underground volume 20. As shown FIGS. 6-7, system 100 includes platform 180 disposed along ocean surface 32. According to the embodiment shown in FIGS. 6-7, platform 180 supports various components of system 100 (e.g., oxidant source 130, storage device 140, control module 152, etc.). As shown in FIGS. 6-7, platform 180 floats along ocean surface 32. According to another embodiment, platform 180 is at least partially supported by a footing (e.g., a footing extending downward to ground surface 22). In still other embodiments, feed pipe 110 and recovery pipe 120 may extend into ocean 30 from an adjacent portion of land (i.e., at least one of oxidant source 130, storage device 140, and control module 152 may be located on-shore, and at least one of feed pipe 110 and recovery pipe 120 may extend into ocean 30 from the shore).

According to the embodiment shown in FIG. 7, feed pipe 110 and recovery pipe 120 are angularly offset relative to at least one of longitudinal axis 12 and ground surface 22. According to the embodiment shown in FIG. 6, feed pipe 110 and recovery pipe 120 extend vertically through ocean 30 underground volume 20. By way of example, feed pipe 110 and recovery pipe 120 may be perpendicular to longitudinal axis 12. By way of another example, feed pipe and recovery pipe 120 may be perpendicular to at least a portion of ground surface 22.

Figure 8:
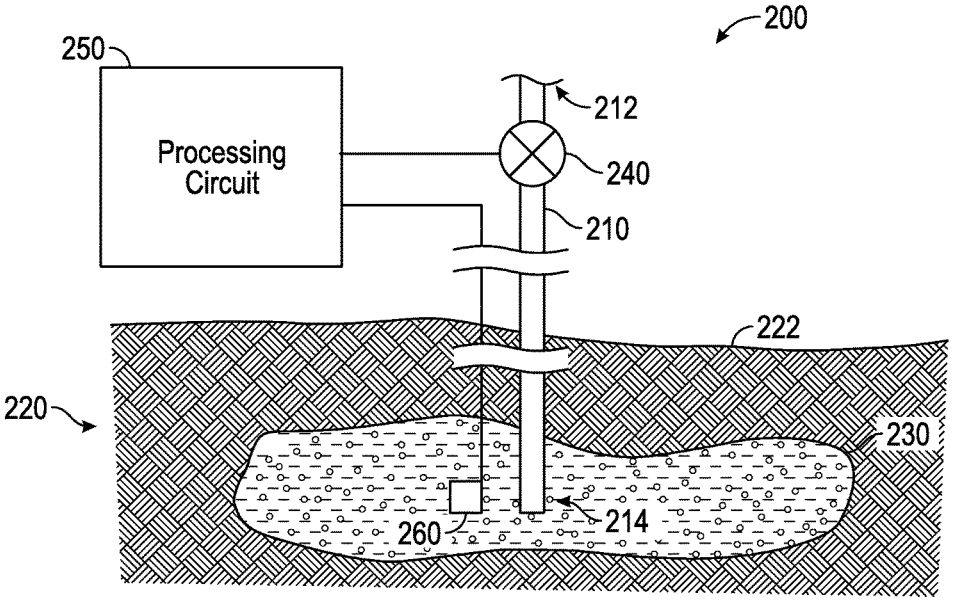
FIG. 8 is a schematic view of a system for removing methane from a subterranean deposit that includes a valve disposed along an oxidant flow path, according to one embodiment.

Referring next to the embodiment shown in FIG. 8, system 200 for removing methane from subterranean clathrate includes a feed pipe, shown as feed pipe 210, that extends through underground volume 220 toward a subterranean methane clathrate deposit, shown as underground deposit 230. System 200 is configured to combust the methane in-situ to generate heat in an exothermic reaction. The heat melts exposed portions of the clathrate to release additional methane. According to one embodiment, system 200 regulates the flow of an oxidant to underground deposit 230 to control the combustion reaction. Control of the combustion reaction may reduce the risk of a run-away combustion reaction where combusted methane generates heat that releases additional clathrate, which is combusted and releases additional methane in an uncontrolled manner. In one embodiment, system 200 is configured to melt and release methane from a target portion of underground deposit 230 while leaving other portions of underground deposit 230 intact (e.g., to provide structural support for a portion of underground volume 220). Run-away combustion may reduce or eliminate the amount of methane that may be collected for later use, may unintentionally melt or otherwise damage portions of underground deposit, or may present still other issues.

Underground deposit 230 is below a ground surface 222 of underground volume 220. As shown in FIG. 8, feed pipe 210 includes an inlet end 212 and an outlet end 214. Inlet end 212 is configured to be coupled to an oxidant source, and outlet end 214 is disposed within underground deposit 230. In one embodiment, feed pipe 210 defines an oxidant flow path between inlet end 212 and outlet end 214. Feed pipe 210 may include a single fluid outlet or a plurality of fluid outlets (e.g., apertures or perforations in a sidewall of feed pipe 210), according to various embodiments. In one embodiment, feed pipe 210 includes a plurality of fluid outlets such that oxidant flowing therethrough is distributed throughout a portion of underground deposit 230. Feed pipe 210 having a plurality of fluid outlets may define a plurality of flow paths between inlet end 212 and each of the fluid outlets.

According to the embodiment shown in FIG. 8, system 200 includes a valve 240 disposed along feed pipe 210. In one embodiment, valve 240 is configured to regulate an oxidant flow (e.g., a flow of compressed gaseous oxygen, a flow of liquid oxygen, a flow of compressed air, etc.) along the oxidant flow path. Valve 240 may actuated between an open position and a closed position. By way of example, valve 240 may be at least partially closed from an open position (e.g., a fully-open configuration) or may be at least partially opened from a closed position (e.g., from a fully-closed configuration), among other potential actuations.

Referring still to the embodiment shown in FIG. 8, system 200 includes a processing circuit 250. Processing circuit 250 may be implemented as a general-purpose processor, an application specific integrated circuit (ASIC), one or more field programmable gate arrays (FPGAs), a digital-signal-processor (DSP), circuits containing one or more processing components, circuitry for supporting a microprocessor, a group of processing components, or other suitable electronic processing components.

In one embodiment, processing circuit 250 includes a processor and a memory. The processor may include an ASIC, one or more FPGAs, a DSP, circuits containing one or more processing components, circuitry for supporting a microprocessor, a group of processing components, or other suitable electronic processing components. In some embodiments, the processor is configured to execute computer code stored in the memory to facilitate the activities described herein. The memory may be any volatile or non-volatile computer-readable storage medium capable of storing data or computer code relating to the activities described herein. In one embodiment, the memory includes one or more code modules (e.g., executable code, object code, source code, script code, machine code, etc.) configured for execution by the processor. In some embodiments, processing circuit 250 may represent a collection of processing devices (e.g., servers, data centers, etc.). In such cases, the processor may be the collective processors of the devices, and the memory may be the collective storage devices of the devices. When executed by the processor, processing circuit 250 is configured to complete the activities described herein.

In one embodiment, processing circuit 250 is configured to generate a command signal that relates to a combustion reaction of methane gas within underground deposit 230. The command signal may include an electrical signal (e.g., a pulsed wave, a continuous wave, etc.), a pneumatic signal, or still another form of communication. The command signal may encode data or may have a specified profile (e.g., a frequency, an amplitude, a shape, etc.) that relates to the combustion reaction.

In one embodiment, valve 240 is coupled to processing circuit 250 and regulates the oxidant flow as a function of the command signal. Such regulation of the oxidant flow may control the combustion reaction within underground deposit 230. It should be understood that combustion of the methane within underground deposit 230 requires the oxidant flow. By way of example, the combustion reaction may have methane and oxygen as reactants and carbon dioxide and water as products. Varying the amount of oxidant (e.g., oxygen) within underground volume 220 may vary at least one of an ignition (e.g., a spread rate, an ignition timing, etc.) and an energetic (e.g., the activation energy, the temperature, etc.) of the combustion reaction. By way of example, reducing the amount of oxidant within underground volume 220 may slow the combustion reaction.

According to another embodiment, system 200 is configured to regulate the position of the oxidant within underground deposit 230. By way of example, system 200 may include a plurality of feed pipes 210 disposed within a number of positions within underground deposit 230. The plurality of feed pipes 210 may disposed according to an array (e.g., a rectangular, a circular array, etc.), irregularly arranged (e.g., based upon the materials or composition of underground volume 220), or disposed in a manner that corresponds to a target portion of underground deposit 230. By way of another example, feed pipe 210 may include a plurality of valves that regulate the flow through a plurality of outlet ports. Opening one or more of the valves may facilitate an oxidant flow therethrough. The valves may be opened or closed (e.g., partially opened, fully-opened, partially closed, fully-closed, etc.) to regulate the position of the oxidant within underground deposit 230. By way of another example, a plurality of feed pipes 210 may include valves disposed along the lengths thereof for further regulate the position of oxidant within underground deposit 230. According to still another embodiment, system 200 is configured to regulate the amount and position of the oxidant within underground deposit 230.

Referring again to the embodiment shown in FIG. 8, system 200 includes sensor 260 positioned within underground deposit 230. In one embodiment, sensor 260 is configured to provide a sensing signal relating to a condition within underground deposit 230. By way of example, the condition may relate to the combustion reaction occurring within underground deposit 230 (e.g., a combustion rate, a spatial distribution of combustion, a cumulative amount of combustion, etc.). By way of another example, the condition may be a temperature, and sensor 260 may include a temperature sensor. By way of still another example, the condition may be a pressure, and sensor 260 may include a pressure sensor. By way of yet another example, the condition may be an oxidant level, and sensor 260 may include an oxidant sensor, such as an oxygen sensor. The condition may be at least one of a methane level, a carbon dioxide level, and a water vapor level, and sensor 260 may include at least one of a methane sensor, a carbon dioxide sensor, and a water vapor sensor, respectively, according to various embodiments.

Processing circuit 250 may be configured to generate the command signal based upon the sensing signal. According to one embodiment, processing circuit 250 is configured to generate the command signal as the sensing signal provided by sensor 260 exceeds a threshold value. In another embodiment, processing circuit 250 is configured to generate the command signal as a condition within underground deposit 230 exceeds a threshold value. By way of example, the threshold value may relate to a combustion rate within underground deposit 230. By way of another example, the threshold value may relate to a temperature or pressure within underground deposit 230. Upon reaching a threshold temperature, which may indicate that the combustion reaction is beginning to occur at too high of a temperature, processing circuit 250 may generate the command signal to control the combustion reaction. By way of example, valve 240 may be configured to close upon receiving the command signal, thereby reducing the amount of oxygen within underground deposit 230 and controlling the combustion reaction (e.g., to reduce the temperature of the combustion reaction, etc.). By way of another example, an oxidant source may be configured to reduce an oxidant flow therefrom upon receiving the command signal, thereby reducing the amount of oxygen within underground deposit 230 and controlling the combustion reaction (e.g., to reduce the temperature or pressure of the combustion reaction, etc.).

In one embodiment, sensor 260 is disposed within a portion of underground deposit 230 that is intended to remain intact and feed pipe 210 is disposed within a target portion of underground deposit 230. Sensor 260 may provide signals relating to the temperature or another condition at the non-target portion of underground deposit 230. Processing circuit 250 may generate the command signal to control the combustion reaction and reduce the risk of melting or otherwise damaging the non-target portion of underground deposit 230 (i.e., sensor 260 may be remotely located, and processing circuit 250 may generate the command signal to throttle the combustion reaction when the temperature at sensor 260 exceeds a threshold value, thereby reducing the risk of melting or otherwise damaging the clathrate at sensor 260).

According to another embodiment, processing circuit 250 is configured to generate the command signal as the condition or the sensing signal provided by sensor 260 falls below a threshold value. By way of example, the threshold value may relate to a combustion rate within underground deposit 230. By way of another example, the threshold value may relate to an oxidant level within underground deposit 230. Upon falling below a threshold oxidant level (e.g., forty percent, etc.), which may indicate that the combustion reaction will begin to occur at too slow of a rate or cease altogether, processing circuit 250 may generate the command signal to control the combustion reaction. By way of example, valve 240 may be configured to open upon receiving the command signal, thereby increasing the amount of oxygen within underground deposit 230 and controlling the combustion reaction. By way of another example, an oxidant source may be configured to increase the oxidant flow therefrom upon receiving the command signal, thereby increasing the amount of oxygen within underground deposit 230 and controlling the combustion reaction (e.g., to increase the temperature within underground deposit 230, etc.).

In one embodiment, processing circuit 250 is configured to generate the command signal according to an injection control strategy. The injection control strategy may include regulating the oxidant flow into underground deposit 230 based on a sensor input. In another embodiment, the injection control strategy includes a time pulsed injection strategy that regulates the combustion reaction. By way of example, valve 240 may be configured to open and close as a function of the command signal, and the command signal may vary at least one of an open time and a position of the valve. By way of another example, an oxidant source may be configured to vary an oxidant flow rate therefrom as a function of the command signal. In one embodiment, processing circuit 250 generates the command signal to pulse the oxidant into underground deposit 230, thereby providing a different combustion profile than a constant flow of oxidant produces. Pulsing the oxidant into underground deposit 230 may produce flashes of higher intensity combustion to melt clathrate without increasing the risk of run-away combustion. The risk of run-away combustion is decreased, according to one embodiment, by pulsing the oxidant into underground deposit 230 to provide digital control of the amount of oxidant available for combustion. A pulse strategy may be employed that controls the amount of oxidant supplied by each pulse, the number of oxidant pulses, the spatial location within underground deposit 230 at which each oxidant pulse is delivered, some combination of these variables, or still other variables. In other embodiments, system 200 continuously provides the oxidant flow to underground deposit 230.

According to one embodiment, an oxidant source is coupled to inlet end 212 of feed pipe 210. The oxidant source may include a tank or a device from which an oxidant flows. The oxidant may include at least one of compressed gaseous oxygen, liquid oxygen, and compressed air.

In one embodiment, system 200 utilizes a buffer fluid to further control the combustion reaction. The buffer fluid may include nitrogen, carbon dioxide, or still another fluid. The buffer fluid may be mixed within the oxidant and stored within the oxidant source according to a fixed mix ratio. In another embodiment, the buffer fluid is provided by a buffer fluid source. The buffer fluid source may include a compressor, another device configured to provide a buffer fluid to underground deposit 230, a tank, or another device configured to store the buffer fluid. The buffer fluid source is in fluid communication with underground deposit 230, according to one embodiment.

System 200 also includes an ignition source configured to trigger a combustion reaction, according to one embodiment. By way of example, the ignition source may ignite or combust an initial volume of methane from underground deposit 230. The initial volume of methane may be naturally occurring within underground deposit 230 or generated using a mechanical process or a thermal process. Ignition or combustion of the initial volume of methane from underground deposit 230 produces an exothermic reaction, thereby generating heat to melt a portion of the clathrate hydrate of underground deposit 230. Melting the clathrate hydrate releases additional methane gas previously stored therein, which at least one of ignites or combusts to perpetuate the combustion reaction. System 200 controls the combustion reaction with valve 240, which regulates the oxidant flow to underground deposit 230 based on the command signal from processing circuit 250.

Figure 9:
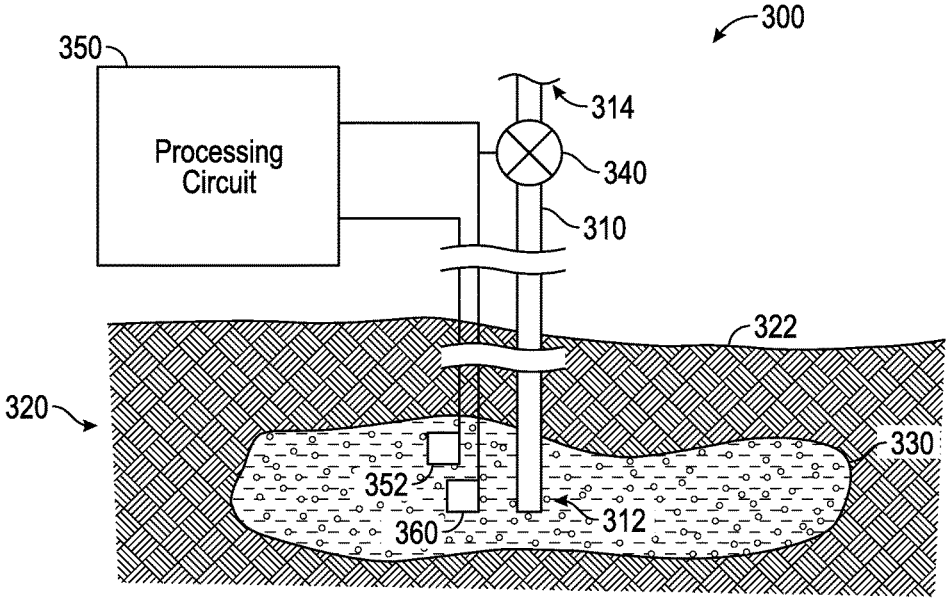
FIG. 9 is a schematic view of a system for removing methane from a subterranean deposit that includes a valve disposed along a recovery pipe, according to one embodiment.

Referring next to the embodiment shown in FIG. 9, system 300 for removing methane from subterranean clathrate includes a recovery pipe, shown as recovery pipe 310, that extends through underground volume 320 toward a subterranean methane clathrate deposit, shown as underground deposit 330. System 300 is configured to combust the methane in-situ to generate heat in an exothermic reaction. The heat melts exposed portions of the clathrate to release additional methane. According to one embodiment, system 300 regulates the flow of released methane gas from underground deposit 330 to control the combustion reaction. Control of the combustion reaction may reduce the risk of a run-away combustion reaction.

Underground deposit 330 is below a ground surface 322 of underground volume 320. As shown in FIG. 9, recovery pipe 310 includes first end 312 and second end 314. In the embodiment shown in FIG. 9, first end 312 is disposed within underground deposit 330. Second end 314 is configured to engage a storage device, according to one embodiment.

In one embodiment, recovery pipe 310 defines a flow path between first end 312 and second end 314. Recovery pipe 310 may include a single fluid inlet or a plurality of fluid inlets (e.g., apertures or perforations in a sidewall of recovery pipe 310), according to various embodiments. In one embodiment, recovery pipe 310 includes a plurality of fluid inlets such that methane flowing therethrough is collected from various portions of underground deposit 330. Recovery pipe 310 having a plurality of fluid inlets may define a plurality of flow paths between each of the plurality of inlets and second end 314.

Referring further to the embodiment shown in FIG. 9, system 300 includes valve 340 disposed along recovery pipe 310. In one embodiment, valve 340 is configured to regulate a methane gas flow (e.g., a flow of methane released from the combustion reaction, a flow of released methane and carbon dioxide or other products of the combustion reaction, etc.) along recovery pipe 310. Valve 340 may be actuated between an open position and a closed position. By way of example, valve 340 may be at least partially closed from an open position (e.g., a fully-open configuration) or may be at least partially opened from a closed position (e.g., from a fully-closed configuration), among other potential actuations.

Referring yet again to the embodiment shown in FIG. 9, system 300 includes a processing circuit 350. Processing circuit 350 may be implemented as a general-purpose processor, an application specific integrated circuit (ASIC), one or more field programmable gate arrays (FPGAs), a digital-signal-processor (DSP), circuits containing one or more processing components, circuitry for supporting a microprocessor, a group of processing components, or other suitable electronic processing components.

In one embodiment, processing circuit 350 includes a processor and a memory. The processor may include an ASIC, one or more FPGAs, a DSP, circuits containing one or more processing components, circuitry for supporting a microprocessor, a group of processing components, or other suitable electronic processing components. In some embodiments, the processor is configured to execute computer code stored in the memory to facilitate the activities described herein. The memory may be any volatile or non-volatile computer-readable storage medium capable of storing data or computer code relating to the activities described herein. In one embodiment, the memory includes one or more code modules (e.g., executable code, object code, source code, script code, machine code, etc.) configured for execution by the processor. In some embodiments, processing circuit 350 represents a collection of processing devices (e.g., servers, data centers, etc.). In such cases, the processor may be the collective processors of the devices, and the memory may be the collective storage devices of the devices. When executed by the processor, processing circuit 350 is configured to complete the activities described herein.

In one embodiment, processing circuit 350 is configured to generate a command signal that relates to a combustion reaction of methane gas within underground deposit 330. The command signal may include an electrical signal (e.g., a pulsed wave, a continuous wave, etc.), a pneumatic signal, or still another form of communication. The command signal may encode data or may have a specified profile (e.g., a frequency, an amplitude, a shape, etc.) that relates to the combustion reaction. In one embodiment, valve 340 is configured to regulate the methane gas flow as a function of the command signal to control the combustion reaction.

Referring still to FIG. 9, system 300 includes an ignition source 360 configured to trigger a combustion reaction, according to one embodiment. By way of example, ignition source 360 may ignite or combust an initial volume of methane from underground deposit 330. Melting the clathrate hydrate releases additional methane gas previously stored therein, which at least one of ignites or combusts to perpetuate the combustion reaction. System 300 controls the combustion reaction with valve 340, which regulates a methane gas flow from underground deposit 330 based on the command signal.

According to one embodiment, regulating the flow of released methane gas controls the combustion reaction. By way of example, limiting the flow may cause a buildup of methane gas within underground deposit 330. Processing circuit 350 may evaluate a sensing signal generated by sensor 352 (e.g., a temperature sensor, a pressure sensor, an oxidant sensor, a methane sensor, a carbon dioxide sensor, a water vapor sensor, etc.) positioned within underground deposit 330. In one embodiment, processing circuit 350 generates the command signal based upon the sensing signal. Accordingly, processing circuit 350 actively controls valve 340 to vary methane recovery and control the combustion reaction.

In one embodiment, system 300 includes an oxidant source configured to provide an oxidant to underground deposit 330. The oxidant source may include a tank or other device configured to store an oxidant, a compressor or other device configured to provide an oxidant, or still another system. A buffer fluid (e.g., a buffer fluid disposed with the oxidant in the oxidant source, a buffer fluid provided by a buffer fluid source, a buffer fluid stored within a separate buffer fluid tank, etc.) may be provided to underground deposit 330 to further control the combustion reaction.

Figure 10:
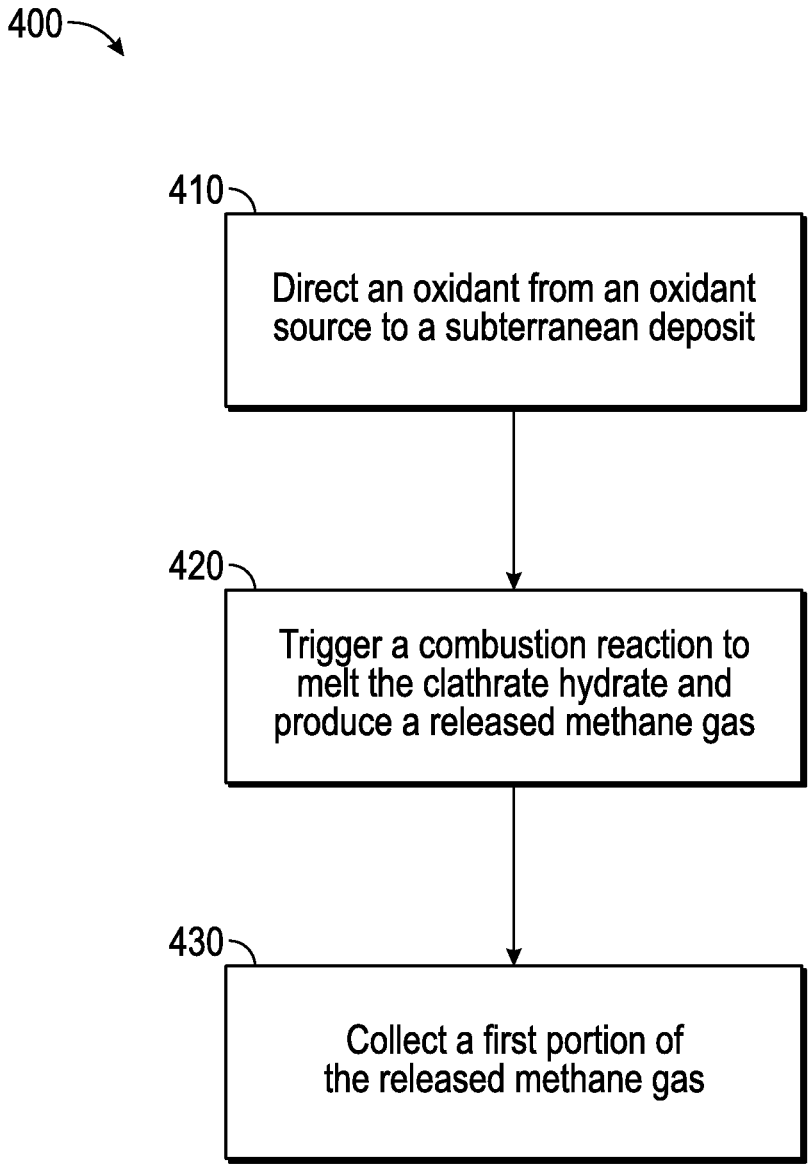
FIG. 10 is a block diagram of a method for removing methane from a subterranean deposit, according to one embodiment.

Referring next to FIG. 10, method 400 for removing methane from subterranean clathrates is shown according to one embodiment. As shown in FIG. 10, method 400 includes directing an oxidant from an oxidant source to a subterranean deposit (410), triggering a combustion reaction to melt the clathrate hydrate and produce a released methane gas (420), and collecting a first portion of the released methane gas (430). In one embodiment, the subterranean deposit includes a stored methane gas disposed within a clathrate hydrate. A second portion of the released methane gas may combust in-situ to perpetuate the combustion reaction.

It is important to note that the construction and arrangement of the elements of the systems and methods as shown in the embodiments are illustrative only. Although only a few embodiments of the present disclosure have been described in detail, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited. For example, elements shown as integrally formed may be constructed of multiple parts or elements. It should be noted that the elements and/or assemblies of the enclosure may be constructed from any of a wide variety of materials that provide sufficient strength or durability, in any of a wide variety of colors, textures, and combinations. The order or sequence of any process or method steps may be varied or re-sequenced, according to alternative embodiments. Other substitutions, modifications, changes, and omissions may be made in the design, operating conditions, and arrangement of the preferred and other embodiments without departing from scope of the present disclosure or from the spirit of the appended claims.

The present disclosure contemplates methods, systems, and program products on any machine-readable media for accomplishing various operations. The embodiments of the present disclosure may be implemented using existing computer processors, or by a special purpose computer processor for an appropriate system, incorporated for this or another purpose, or by a hardwired system. Embodiments within the scope of the present disclosure include program products comprising machine-readable media for carrying or having machine-executable instructions or data structures stored thereon. Such machine-readable media can be any available media that can be accessed by a general purpose or special purpose computer or other machine with a processor. By way of example, such machine-readable media can comprise RAM, ROM, EPROM, EEPROM, CD-ROM or other optical disk storage, magnetic disk storage or other magnetic storage devices, or any other medium which can be used to carry or store desired program code in the form of machine-executable instructions or data structures and which can be accessed by a general purpose or special purpose computer or other machine with a processor. When information is transferred or provided over a network or another communications connection (either hardwired, wireless, or a combination of hardwired or wireless) to a machine, the machine properly views the connection as a machine-readable medium. Thus, any such connection is properly termed a machine-readable medium. Combinations of the above are also included within the scope of machine-readable media. Machine-executable instructions include, for example, instructions and data, which cause a general-purpose computer, special purpose computer, or special purpose processing machines to perform a certain function or group of functions.

Although the figures may show a specific order of method steps, the order of the steps may differ from what is depicted. Also two or more steps may be performed concurrently or with partial concurrence. Such variation will depend on the software and hardware systems chosen and on designer choice. All such variations are within the scope of the disclosure. Likewise, software implementations could be accomplished with standard programming techniques with rule-based logic and other logic to accomplish the various connection steps, processing steps, comparison steps, and decision steps.

What is claimed is:

1. A system for removing methane from subterranean clathrates, comprising:

an oxidant source;

a feed pipe including an inlet end in fluid communication with the oxidant source and an outlet end configured to be disposed within a subterranean deposit that includes a stored methane gas disposed within a clathrate hydrate, wherein the feed pipe defines an oxidant flow path between the inlet end and the outlet end;

a recovery pipe including a first end disposed within the subterranean deposit and a second end opposite the first end and configured to engage a storage device;

an ignition source configured to trigger a combustion reaction to melt the clathrate hydrate and produce a released methane gas;

a buffer fluid source configured to provide a buffer fluid to the subterranean deposit;

a sensor configured to provide a sensing signal relating to a condition within the subterranean deposit; and a processing circuit configured to:

determine a mix ratio of the buffer fluid relative to the oxidant based on the sensing signal; and generate a command signal to limit the combustion reaction by controlling delivery of the buffer fluid according to the mix ratio, wherein a first portion of the released methane gas travels along a recovery flow path through the recovery pipe and a second portion of the released methane gas combusts with the oxidant in-situ to perpetuate the combustion reaction.

2. The system of claim 1, wherein the ignition source includes a spark generator such that the combustion reaction includes a flame combustion reaction.

3. The system of claim 1, wherein the ignition source includes a catalytic substance such that the combustion reaction includes a catalytic combustion reaction.

4. The system of claim 1, wherein the oxidant source is configured to store an oxidant and a buffer fluid.

5. The system of claim 4, wherein the oxidant source is configured to store the oxidant and the buffer fluid at a mix ratio, and wherein the mix ratio remains fixed during the combustion reaction.

6. The system of claim 1, wherein the buffer fluid source is in fluid communication with the oxidant flow path.

7. The system of claim 1, further comprising a buffer feed pipe including an inlet end in fluid communication with the buffer fluid source and an outlet end configured to be disposed within the subterranean deposit.

8. The system of claim 1, further comprising:

a valve disposed along the oxidant flow path, wherein the valve is configured to regulate an oxidant flow along the oxidant flow path;

wherein the sensor is configured to monitor a combustion rate of the combustion reaction; and wherein the valve is configured to regulate the oxidant flow as a function of the command signal to control the combustion reaction.

9. The system of claim 8, wherein the sensing signal relates to a condition that is associated with the combustion rate, wherein the condition includes at least one of a temperature, a pressure, an oxidant level, a methane level, a carbon dioxide level, and a water vapor level within the subterranean deposit.

10. The system of claim 8, wherein the processing circuit is configured to generate the command signal according to an injection control strategy.

11. The system of claim 8, further comprising a buffer feed pipe including an inlet end configured to be coupled to the buffer fluid source and an outlet end configured to be disposed within the subterranean deposit, wherein the buffer feed pipe defines a buffer fluid flow path between the inlet end and the outlet end.

12. The system of claim 8, wherein the processing circuit is configured to generate the command signal in response to the combustion rate exceeding a threshold value, and wherein the valve is configured to close upon receiving the command signal.

13. The system of claim 12, wherein the threshold value relates to at least one of a temperature, a pressure, an oxidant level, a methane level, a carbon dioxide level, and a water vapor level within the subterranean deposit.

14. The system of claim 8, wherein the processing circuit is configured to generate the command signal in response to the combustion rate falling below a threshold value, and wherein the valve is configured to open upon receiving the command signal.

15. The system of claim 14, wherein the threshold value relates to at least one of a temperature, a pressure, an oxidant level, a methane level, a carbon dioxide level, and a water vapor level within the subterranean deposit.

16. The system of claim 8, wherein the buffer fluid source includes a tank having a shell defining an internal volume.

17. The system of claim 16, wherein the tank includes an outlet port, and wherein the outlet port is in fluid communication with the feed pipe.

18. The system of claim 8, wherein the ignition source is disposed at least one of within and along the subterranean deposit.

19. The system of claim 18, wherein the ignition source includes a spark generator such that the combustion reaction includes a flame combustion reaction.

20. The system of claim 18, wherein the ignition source includes a catalytic substance such that the combustion reaction includes a catalytic combustion reaction.

21. The system of claim 1, further comprising:

a valve disposed along the recovery pipe, wherein the valve is configured to regulate a flow of the released methane gas through the recovery pipe; and wherein the processing circuit is configured to generate a command signal to control operation of the valve, wherein the valve regulates the flow of the released methane gas as a function of the command signal to control the combustion reaction.

22. The system of claim 21, wherein the sensor includes at least one of an oxidant sensor, a carbon dioxide sensor, a methane sensor, a water vapor sensor, a temperature sensor, and a pressure sensor.

23. The system of claim 1, wherein the condition relates to a combustion rate within the subterranean deposit.

24. The system of claim 1, wherein the condition relates to at least one of a temperature, a pressure, an oxidant level, a methane level, a carbon dioxide level, and a water vapor level within the subterranean deposit.

* * * * *